United States Patent [19]

Lown et al.

[11] Patent Number: 5,000,360

[45] Date of Patent: Mar. 19, 1991

[54] POURING SPOUT WHICH CAN BE SELECTIVELY OPENED AND CLOSED

[76] Inventors: John Lown, 222 La Jolla, Newport Beach, Calif. 92663; Paul Maguire, 4284 Seaview La., Los Angeles, Calif. 90065

[21] Appl. No.: 413,185

[22] Filed: Sep. 27, 1989

[51] Int. Cl.[5] ..... B67D 5/72

[52] U.S. Cl. ..... 222/521; 222/568

[58] Field of Search ..... 222/519–520, 222/566–571, 528–532, 537–539, 478, 481

[56] References Cited

U.S. PATENT DOCUMENTS

| | | | |
|---|---|---|---|
| 216,530 | 6/1879 | Pfitzenmeier . | |
| 1,974,348 | 9/1934 | Strehs | 222/520 X |
| 2,533,915 | 12/1950 | Brooks | 222/520 X |
| 2,556,627 | 6/1951 | Miksis | 222/568 |
| 2,591,231 | 4/1952 | Boadway | 222/521 |
| 2,736,469 | 2/1956 | Stone | 222/529 |
| 2,757,831 | 8/1956 | Schmidt | 222/539 |
| 2,759,643 | 8/1956 | Dahlin | 222/521 |
| 2,782,967 | 2/1957 | Walker | 222/485 |
| 3,206,083 | 9/1965 | Nishina | 222/568 X |
| 3,305,127 | 2/1967 | Baranne | 222/521 UX |
| 3,486,503 | 12/1969 | Porter et al. | 222/568 X |
| 3,537,623 | 11/1970 | Fisher | 222/570 X |
| 4,129,236 | 12/1978 | Wrycraft et al. | 222/570 |
| 4,217,940 | 8/1980 | Wheeler | 222/568 X |
| 4,426,027 | 1/1984 | Maynard, Jr. | 222/529 |
| 4,461,454 | 7/1984 | Vadnais | 222/521 X |
| 4,572,386 | 2/1986 | Marcus | 222/568 X |
| 4,583,668 | 4/1986 | Maynard, Jr. | 222/568 X |
| 4,600,125 | 7/1986 | Maynard, Jr. | 222/529 X |
| 4,705,192 | 11/1987 | Knapton | 222/568 X |
| 4,777,990 | 10/1988 | Grant | 222/529 X |
| 4,811,865 | 3/1989 | Mueller, Jr. et al. | 222/539 X |
| 4,832,238 | 5/1989 | Taylor | 222/568 X |

FOREIGN PATENT DOCUMENTS

| | | | |
|---|---|---|---|
| 0000686 | 2/1979 | European Pat. Off. | 222/521 |
| 239998 | 9/1925 | United Kingdom | 222/529 |
| 943452 | 12/1963 | United Kingdom | 222/521 |

*Primary Examiner*—Kevin P. Shaver
*Attorney, Agent, or Firm*—Jackson & Jones

[57] ABSTRACT

A pouring spout which can be selectively opened or closed to pass materials therethrough. The spout includes a threaded end which is adapted to engage a container, a spout body for conducting the materials from the container and an adjustable end which is adapted to selectively interrupt the flow of materials through the spout.

18 Claims, 1 Drawing Sheet

POURING SPOUT WHICH CAN BE SELECTIVELY OPENED AND CLOSED

BACKGROUND

1. Field of the Invention. This invention is directed to a pouring spout, in general, and to a pouring spout which can be selectively opened or closed to interrupt the flow of materials through the spout, in particular.

2. Prior Art. There are many types of spouts known in the prior art. These include pouring spouts which can be inserted into containers to conduct the contents thereof from the container. Typical of this type of spout is the oil-can spout which is inserted into the oil-can by puncturing the top thereof.

Other spouts include spouts which are integrally involved with the container. Typical of such spouts are the pull-up spouts associated with salt containers or the like. Many containers such as gasoline containers or the like include spouts or hoses which can be attached to the container by means of a threaded end.

Some spouts such as those used with faucets or funnels, include valves therein, normally a ball-valve or the like, which can selectively interrupt the flow through the spout.

However, most of these components have shortcomings in one or more areas of utilization. For example, a valved funnel, typically, does not include a threaded end. The faucet-type spout does not include a spout which is readily detachable from a container (or source of materials). The oil-can spout causes or permits dripping of product.

In the current age of do it yourself operations, especially in maintenance of automobiles or similar vehicles, the owner of the vehicle frequently has to insert fluids into the appropriate location. This can include, for example, oil into the crankcase; anti-freeze into the radiator; battery fluid into the battery; and/or brake fluid into a master cylinder. Of course, other fluids or substances can be added to other areas of the vehicle. The listing above is not intended to be limitative or all inclusive.

In performing these tasks, many of the containers which are now utilized for containing oil, anti-freeze, brake fluid or the like come in containers which have a threaded neck. These containers are frequently formed of plastic and/or metal. The conventional method of utilization is to remove the cap from the container and pour the contents into the vehicle receptacle directly or through a funnel. In the case of the oil-can spout of the "puncture-type", the spout operates in a similar fashion.

However, it is well known that in performing any of these tasks, a substantial margin for error exists and product from the container is dripped or spilled during the process. In the instances where funnels are used, it is often difficult to gauge the capacity of the receptacle wherein excessive material is supplied to the funnel and spilled on the floor or on the vehicle engine. Other similar problems occur frequently. Consequently, it is highly desirable to provide an improved spout which is adapted to engage with the container and to selectively permit closure of the spout so that a controlled amount of material can be transferred from the container to the receptacle.

SUMMARY OF THE INSTANT INVENTION

This invention is directed to a spout which is adapted to be attached to a container and which permits selective opening or closing thereof.

In the preferred embodiment, the spout includes three major components which are joined together by a snap-on connection arrangement. The main spout body is a slightly arcuate tube or cylinder. A threaded cap arrangement is adapted to snap onto one end of the spout body. A stepped down, funnel-like end is adapted to snap onto the other end of the spout body. The cap and the associated end of the spout body are arranged to interact through a connection which is completely free to rotate but capable of sealing to this container. The funnel-like end interacts with the spout body through a camming arrangement wherein a stopper device (usually joined to the spout body) selectively engages the funnel-end so as to block flow therethrough.

PRIOR ART STATEMENT

The listed patents were uncovered in a preliminary patentability search. The patents are listed in descending numerical order; no other significance is intended.

U.S. Pat. No. 4,705,192; Reusable Multi-Compartment Container With Charging and Discharging Means; P. Knapton. This patent is directed to a container for storing a plurality of substance and includes a flow-directing funnel.

U.S. Pat. No. 4,600,125; Liquid Funnel and Pouring Spout Combination: W. Maynard Jr. The patent is directed to a pouring device with a primary funnel (with a container piercing element), as well as secondary and tertiary spout extensions for reaching relatively inaccessible receptacles. A closure plug fits all of the spouts.

U.S. Pat. No. 4,583,668; Pouring Spout For Diverse Liquid Containers: W. Maynard, Jr. The patent is directed to a threaded, elongated pouring spout which is connectable to different size containers.

U.S. Pat. No. 4,217,940; Funnel Having An Integral Pouring Spout; M. Wheeler. This patent is directed to a funnel having an integral pouring spout attached to the inner surface of the funnel.

U.S. Pat. No. 2,782,967; Screw-On Pouring Spout; R. Walker. This patent is directed to a replacement cap for a container which operates as a pouring spout without redesign of the container.

U.S. Pat. No. 2,556,627; Adapter For Fuel Can Spout For Accommodation of Nozzles of Different Diameters: R. Miksis. This patent is directed to a dispensing spout which can be used interchangeably on fluid container and includes a stepped socket with different diameters.

U.S. Pat. No. 216,530; Measuring Funnel: J. Pfitzenmeier. This patent is directed to a funnel formed of several sections with increasing diameter.

DESCRIPTION OF THE PREFERRED EMBODIMENT

Throughout this description, common components bear the same numerals.

Figure 1:
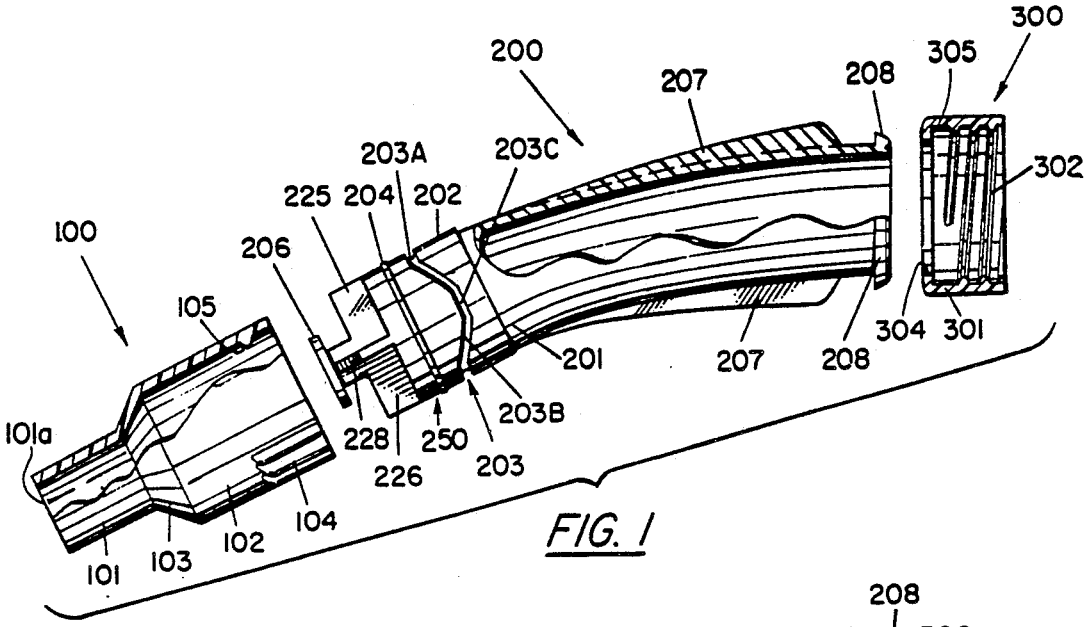
FIG. 1 is a partially broken away, partially sectional, exploded view of the pouring spout of the instant invention.

Referring now to FIG. 1, there is shown an exploded view of the spout apparatus of the instant invention. In addition, certain portions of the spout are shown partially broken away or partially in section in order to assist in the understanding thereof. In particular, the threaded connector member or cap 300 is shown in cross section. The cap 300 is a typical annular-type cap which has an outer surface 301 and an inner surface which is molded or machined to include threads 302. The outer surface can be knurled or otherwise configured for ease of manipulation by the user. The threads 302 are made up in a conventional configuration to mate with the threads on standard containers currently utilized in the industry. These containers may be used to hold anti-freeze, oil, brake fluid, or any other similar type of material. While many of these containers are standardized to have a conventional or standard size and thread configuration, other caps 300 can be used with the invention in order to mate with other types of containers.

The open end of the cap 300 is adapted to receive the threaded mouth or neck of the container. The other end of the cap 300 includes an aperture 304 which is, conventionally, a circularly shaped opening at the end of the cap and adapted to receive the spout body 200 as described hereinafter. The opening 304 is defined to be slightly smaller than the inner diameter of the cap whereby an internal shoulder 305 is provided at the edge of the opening 304. The shoulder 305 operates to retain the spout body 200.

A funnel member or closure cap 100 is adapted to engage the other end (pouring end) of the spout body (tubular body member) 200. The closure cap 100 includes, in this embodiment, a relatively large diameter, substantially cylindrical portion 102 which surrounds the tubular body member adjacent the pouring end thereof and a relatively small diameter, substantially cylindrical portion 101 which terminates at the outlet end 101*a*. The cylindrical portions 101 and 102 are joined together by a tapered section 103. A plurality of fins 104 or other protuberances extend from the outer surface of the larger portion 102 of the cap 100. These fins are in the nature of a knurled finish or the like in order to permit ease of manipulation of the closure cap 100.

A cam-follower 105 is provided on the inner surface of the larger cylindrical portion 102. In point of fact, a pair of diametrically opposed cam-followers 105 may be incorporated in the cap 100. The cam-followers may take the form of a pin or small bump on the inner surface of the closure cap portion 102

The main spout body 200 is a slightly arcuate, hollow, substantially cylindrical, tube-like arrangement. The tube 201 may curve through an arc of approximately 23.5°, for example. Of course, this dimension is a representation and not limitative. At one end (i.e. attachment end) of the tube 201 is a lip 208. The lip 208 has a flat inner edge and a rounded outer edge. This configuration permits the lip 208 to traverse the opening 304 in cap 300 and to be, effectively, captured therein by the relatively flat surface of shoulder 305.

A plurality of fins or vanes 207 extend outwardly from the outer surface of the arcuate tube 201. The vanes 207 provide structural strength for the spout body and, as well, an easy means for grasping the device.

At the other end of the arcuate tube 201 is a so-called "stopper end" 250 which includes a cylindrical unit which has substantially the same inner diameter as the tube 201. The outer diameter of the stopper end of spout body 200 can be slightly larger than the outer diameter of arcuate tube 201. (This arrangement is not required, however.) A sealing ring 204 extends radically outwardly from the surface of a stopper end of the spout body 200. The sealing ring 204 is arranged to abut with and form a seal against the inner surface of portion 102 of the closure cap 100. In addition, a cam-slot 203 is provided in the outer circumference of the stopper end 250. The cam-slot 203 does not pass all the way through the stopper end 250. The cam slot 203 is, essentially, symmetrical around the circumference of the stopper end 250. Thus, two high points 203A are provided on opposite sides of the cylinder 250. Likewise, two low points 203C are provided on opposite sides of the cylinder 250 but are spaced equi-distant from the high points 203A. The respective high and low points are connected by sloped or angled connecting grooves 203B. The high and low points also comprise relatively flat segments to provide a latching apparatus for the cam follower 105 in closure cap 100.

Figure 4:
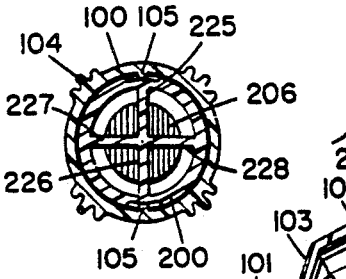
FIG. 4 is a sectional view of the cap-end of the spout taken along the lines 4—4 in FIG. 2.

A stopper 206 in the form of a disk is mounted to appropriate ribs 225, 226, 227 and 228. (Rib 228 is not visible in FIG. 1 but is shown in FIG. 4.) The ribs 225–228 extend outwardly from the cylinder 250 of closure cap with a step-down portion adjacent to the stopper 206. The ribs or vanes 225, 226, 227 and 228 are relatively thin vanes which extend into the cylinder 250. However, these vanes are arranged to not impede, in any substantial fashion, the flow of materials through the spout.

Preferably, the material for the spout is made of a high impact, relatively strong, plastic material such as polyethelene. The stopper cap 206 is arranged to have a slight degree of flexibility so as to better conform to the tapered inner surface of the closure cap 100. This will permit a better seal in the "off" or "closed position". However, the material must have a substantial degree of "resilience" or "memory" so that the stopper 206 will not be permanently deformed.

Figure 2:
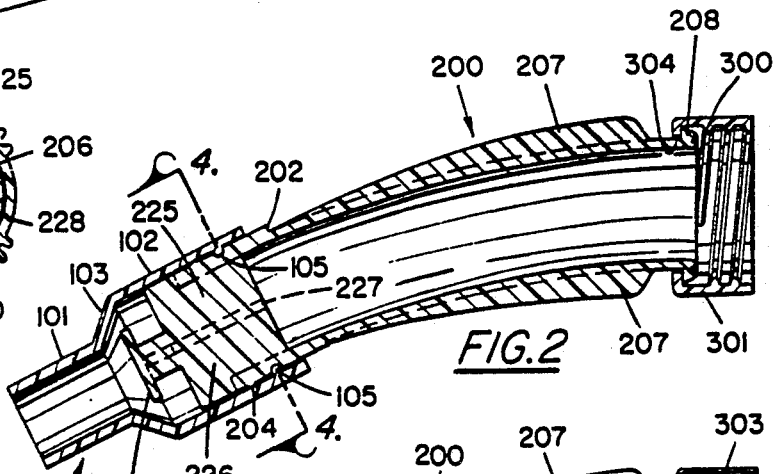
FIG. 2 is a fully assembled, cross-sectional view of the pouring spout of the instant invention in the "open" position.

Referring now to FIG. 2, there is shown a cross-sectional view of the apparatus in the assembled condition. A cross-sectional view is provided in order to demonstrate the inner connection, for example, of the cap 300 with the body 200. In particular, the lip 208 is shown to interact and interlock with the opening 304 and shoulder 305 in the cap 300. However, the cap 300 is free to rotate around the end of the spout body 200.

At the other end of the spout body 200, the closure cap 100 is mounted with the cam-followers 105 engaged, as shown, in the cam-groove 203. In particular, as shown in FIG. 2, i.e. the "open" position, the cam-followers 105 are disposed in the high point 203A of the cam-groove. Thus, closure cap 100 is spaced forwardly with respect to the spout body 200. The ribs 225, 226, 227 and 228 (shown dashed) provide a mounting arrangement for the stopper 206, but provide ample space therearound for the materials to pass through the spout and through the closure cap 100.

Figure 3:
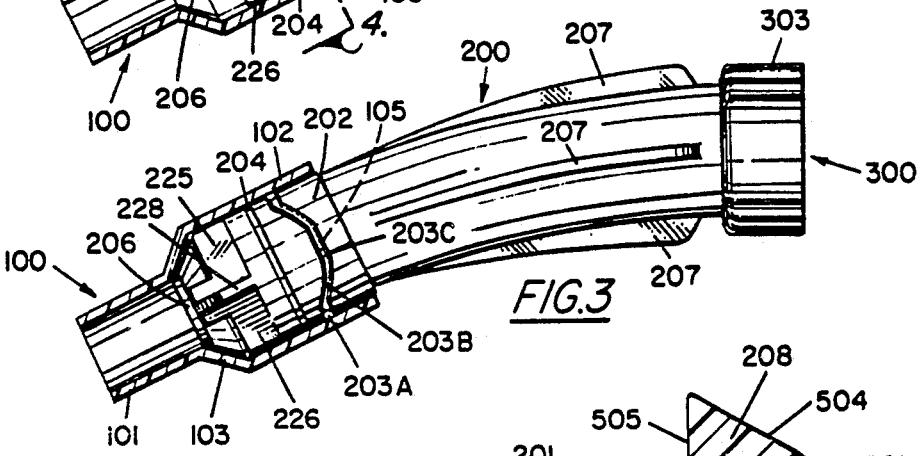
FIG. 3 is a fully assembled, partially broken away, partially sectional view of the pouring spout of the instant invention in the "closed" position.

Referring now to FIG. 3, the spout is shown in the "closed" position. In this case, the closure cap 100 has been turned or rotated approximately 90°. The cam-follower 105 has followed the cam-groove 203 and rests in the low point 203C. This arrangement has the effect of drawing the closure cap 100 onto the end of spout body 200. The dimensions of the cam-groove 203 are arranged so that the closure cap 100 is moved and the tapered sides 103 move into contact with the stopper 206. The relative dimensions of the stopper 206, the tapered side 103, and the inner diameter of the small end 101 of closure cap 100 operate to block the flow of the materials through the closure cap (and, thus, the pouring spout).

It is clear that the cam followers 105 will remain in the low points 203C of the cam-groove until overtly and positively moved to the high point position 203A. Until so moved, the stopper cap 206 has blocked the flow of materials through the pouring spout.

This operation of the spout can be accomplished easily, even while material is flowing through the spout, by merely rotating the closure cap 100. Suitable indicia can be used to indicate the position of closure cap 100 in the "full open" or "full closed" position. Rotation of the cap 100 relative to the tubular body member 200 provides a variable orifice between the stopper disc 206 and the tapered side 103 of the funnel member or closure cap 100. This indicia can take the form of lines or grooves in the body of the spout, if so desired.

Referring now to FIG. 4, there is shown a cross-sectional view of the stopper end of the spout and the closure cap 100 taken along the lines 4—4 in FIG. 2. Thus, the cylindrical configuration of the cap 100 with the ribs or vanes 104 extending therefrom is clear. The cam-followers 105 which extend outwardly are also shown. The stopper 206 is shown mounted on the ribs 225, 226, 227 and 228. These ribs are shown to intersect in a cruciform arrangement to permit maximum flow space therearound.

Figure 5:
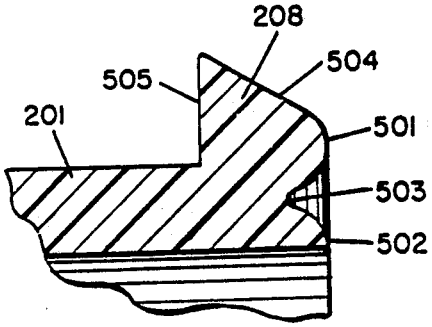
FIG. 5 is a detailed showing of the double-lip edge of the spout body shown in FIG. 1.

Referring now to FIG. 5, there is shown a detailed arrangement of one embodiment of the lip 208 shown in FIGS. 1 and 2. In this embodiment, the edge or lip 208 includes a dual or double arch portion.

In particular, the lip extends from the body 201 which is shown in fragmentary view. The cross-sectional arrangement shows the angled edge 504 which permits the end of the spoutbody 200 to be easily and readily inserted into the opening 304 in the cap 300. The flat surface 505 is arranged to abut against the inner surface of shoulder 305 of cap 300 to prevent the separation of the cap 300 and the spout body 200. The other surface of the lip 208 includes a pair of arcuate surfaces 501 and 502 joined together by a depression 503. This edge or lip arrangement permits the arcuate surface of the edge 208 to readily accommodate and be separately compressed by different sizes or configurations of containers which are threadedly engaged by the cap 300.

That is, some containers on the market have a relatively straight or flat surface at the outer edge of the threaded neck while some containers have a relatively bevelled or angled surface at the outer edge surface. These container end surfaces require different types of receiving surfaces in order to form a leakproof seal. By using the "double-arch" surfaces 501 and 502, either of the kinds of bottles or containers noted above can be utilized with the spout of the instant invention.

Thus, there is shown and described a unique configuration of a selective pouring spout. The spout can be operated to be turned "on" (to pass material therethrough) or turned "off" (to prevent the flow of materials therethrough). The particular configuration shown and described herein is directed to a preferred embodiment of the instant invention. While this description is directed to a particular embodiment, it is understood that those skilled in the art may conceive modifications and/or variations to the specific embodiments shown and described herein. Any such modifications or variations would fall within the purview of this description are intended to be included therein as well. It is understood that the description herein is intended to be illustrative only and is not intended to be limitative. Rather, the scope of the invention described herein is limited only by the claims appended hereto.

We claim:

1. A pouring spout adapted to be releasably secured to an oil container or the like comprising:

(a) a tubular body member having an attachment end and a pouring end, the attachment end defining an annular lip extending outwardly from the body member and the pouring end having a cylindrically shaped outer surface portion;

(b) connector member rotatably mounted on the attachment end of the tubular body member and extending over the lip thereof, the connector member defining threads adapted to engage complementary threads on the container;

(c) a funnel shaped member rotatably mounted on the tubular body member adjacent the pouring end thereof, the funnel shaped member including a rear cylindrical section having a cylindrically shaped inner surface which surrounds the tubular body member adjacent the pouring end thereof and a front cylindrical section of smaller diameter than the pouring end of the tubular body member and a tapered section joining the front and rear sections, the funnel shaped member further having an outlet end through which material to be dispensed from the container flows, one of said funnel shaped member cylindrically inner surface and tubular body member outer surface defining a cam surface and the other of said surfaces defining a cam lobe follower, the cam surface extending circumferentially about the tubular body member from at least one high point to at least one low point, the low point being positioned at a greater distance from the pouring end of the tubular body member than the high point so that rotation of the funnel shaped member in either direction relative to the tubular body member causes the outlet end of the funnel shaped member to move toward and away from the pouring end of the tubular body member, the tubular body and funnel shaped members having cooperating closure means comprising a stopper member mounted on the pouring end of the tubular body member for sealingly engaging the taped section of the funnel shaped member when the outlet end of the funnel shaped member is moved toward the pouring end of the tubular body member the maximum distance allowed by the cam surface and the cam lobe follower.

2. The pouring spout of claim 1 wherein the cam surface includes at least one relatively flat segment for causing the cam lobe follower to latch the closure means in the fully closed position.

3. The pouring spout of claim 2 wherein one of the funnel shaped and tubular body members includes a sealing ring for engaging the other of said members at a location spaced from the cam surface to prevent passing of materials through the pouring end of the tubular body member from along the exterior surface of the tubular body member toward the attachment end thereof.

4. The pouring spout of claim 2 wherein the stopper member is a resilient disc.

5. The pouring spout of claim 4 wherein the tubular member is curved.

6. The pouring spout of claim 5 wherein the degree of curvature of the tubular member is about 23.5°.

7. The pouring spout of claim 4 wherein the connector member defines an inwardly projecting shoulder and wherein the lip of the tubular body member defines a substantially flat connector engaging surface extending outwardly from the tubular body member for engaging the shoulder of the connector member.

8. The pouring spout of claim 7 wherein the outer surface of the lip includes an arcuate surface extending from the outer portion of the flat surface toward the attachment end of the tubular member for engaging the opening in a container.

9. The pouring spout of claim 8 wherein the outer surface of the lip includes a pair of arcuate surfaces joined by a depression disposed at the attachment end of the tubular member for sealingly engaging a beveled surface surrounding the opening in the container.

10. The pouring spout of claim 4 wherein the tubular body member includes a plurality of ribs which secure the resilient disc, the ribs permitting the flow of materials through the tubular member, over the resilient disc and through the funnel shaped member when the closure means is open.

11. The pouring spout of claim 4 wherein the at least one high point comprises two diametrically opposed high points and wherein the at least one low point comprises two diametrically opposed low points, and wherein the low points are separated from the high points by 90 degrees so that the funnel shaped member is rotated through about 90 degrees to close the pouring end of the tubular body member from its fully open position and vice versa.

12. The pouring spout of claim 2 wherein the cam surface comprises a continuous ramping groove on the tubular body member adjacent the pouring end thereof and the cam lobe follower comprises a pair of diametrically opposed projections extending inwardly from the interior surface of the funnel shaped member.

13. A variable orifice pouring spout adapted to be releasably secured to an oil container or the like comprising:

(a) a tubular body member having an attachment end and a pouring end;

(b) a connector member rotatably mounted on the attachment end of the tubular body member, the connector member defining threads adapted to engage complementary threads on the container to secure the tubular body member thereto, and (c) a funnel shaped member rotatably mounted on the tubular body member adjacent the pouring end thereof, the funnel shaped member having a rear cylindrical section which surrounds the tubular body member adjacent the pouring end thereof and a front cylindrical section of smaller diameter than the pouring end of the tubular member and a tapered section joining the front and rear sections, the funnel shaped member further having an outlet end through which material to be dispensed from the container flows, one of the funnel shaped and tubular body members defining a cam surface and the other of said members defining a cam lobe follower, the cam surface extending circumferentially about the tubular body member from at least one high point to at least one low point, the low point being positioned at a greater distance from the pouring end of the tubular body member than the high point so that rotation of the funnel shaped member relative to the tubular body member causes the outlet end of the funnel shaped member to move toward and away from the pouring end of the tubular body member, the tubular body and funnel shaped member having cooperating closure means comprising a resilient disc mounted on the pouring end of the tubular body member for sealingly engaging the tapered section of the funnel shaped member when the outlet end to the funnel shaped member is moved toward the pouring end of the tubular body member the maximum distance allowed by the cam surface and cam lobe follower, the cam surface including at least one relatively flat segment for causing the cam lobe follower to latch the closure means in a fully closed position.

14. The pouring spout of claim 13 wherein the high and low points on the cam surface comprises relatively flat segments for causing the cam follower to latch the closure means in the open and closed positions and a curved segment interconnecting the flat segments.

15. The pouring spout of claim 14 wherein one of the funnel shaped and tubular body members includes a sealing ring for engaging the other of said members at a location spaced from the cam surface to prevent materials flowing through the pouring end of the tubular body member from flowing along the exterior surface of the tubular body member toward the attachment end thereof.

16. The pouring spout of claim 15 wherein the tubular body member includes a plurality of ribs which secure the resilient disc to the pouring end of the tubular body member, the ribs permitting the flow of materials through the tubular body member, over the resilient disc and through the funnel shaped member when the closure means is open.

17. The pouring spout of claim 16 wherein the at least one high point comprises two diametrically opposed high points and wherein the at least one low point comprises two diametrically opposed low points, and wherein the low points are separated from the high points by 90 degrees so that the funnel member is rotated through about 90 degrees to close the pouring end of the tubular body member from its fully open position and vice versa.

18. The pouring spout of claim 17 wherein the cam surface is a continuous slot on the tubular shaped member adjacent the pouring end thereof and cam lobe follower is a pair of diametrically opposed projections extending inwardly from the interior surface of the funnel member such that the funnel member may be rotated in either direction relative to the tubular body member to cause the closure means to move from a fully open to a fully closed position and vice versa.

* * * * *

UNITED STATES PATENT AND TRADEMARK OFFICE

CERTIFICATE OF CORRECTION

PATENT NO. : 5,000,360

DATED : March 19, 1991

INVENTOR(S) : John Lown and Paul Maguire

It is certified that error appears in the above-identified patent and that said Letters Patent is hereby corrected as shown below:

Column 1, line 20, after "like." a new paragraph should begin with the word "Many".

Column 6, line 24, before "connector" should be --a--.

Column 6, line 57, "taped" should read --tapered--.

Column 8, line 53, after "funnel" should be --shaped--.

Signed and Sealed this

Sixth Day of April, 1993

*Attest:*

STEPHEN G. KUNIN

*Attesting Officer*

*Acting Commissioner of Patents and Trademarks*